United States Patent [19]

Hendrix

[11] Patent Number: 4,991,278

[45] Date of Patent: Feb. 12, 1991

[54] DEVICE FOR HANGING AND LEVELING WALL HANGINGS

[76] Inventor: Henry E. Hendrix, No. 3 Girard St., Fort Smith, Ark. 72901

[21] Appl. No.: 449,083

[22] Filed: Dec. 8, 1989

Related U.S. Application Data

[63] Continuation of Ser. No. 267,931, Nov. 7, 1988, abandoned.

[51] Int. Cl.[5] ..... B25B 27/20

[52] U.S. Cl. ..... 29/278; 29/270; 29/281.1; 29/798; 81/44; 227/147

[58] Field of Search ..... 29/270, 278, 281.1, 29/407, 716, 798; 81/44; 227/147

[56] References Cited

U.S. PATENT DOCUMENTS 4,037,632 7/1977 Arena ..... 81/44

4,403,725 9/1983 Lawrence ..... 227/147

4,676,424 6/1987 Meador et al. ..... 227/147

FOREIGN PATENT DOCUMENTS 75330 3/1983 European Pat. Off. ..... 81/44

*Primary Examiner*—Joseph M. Gorski

*Assistant Examiner*—Peter Dungba Vo

*Attorney, Agent, or Firm*—Thomas C. Saitta

[57] ABSTRACT

A method and device for securing wall hangings to a wall, whereby double-pointed pins are inserted into the rear of the wall hanging and the wall hanging is then leveled and the pins are pressed into the wall to secure the wall hanging. The device is a hand held tool shaped to fit in the palm of the user's hand. Incorporated in the device is a level means and a means to hold the double-pointed pins for insertion into the rear of the wall hanging.

7 Claims, 1 Drawing Sheet

DEVICE FOR HANGING AND LEVELING WALL HANGINGS

This is a Continuation of application Ser. No. 07/267,931, filed 11/07/88, now abandoned.

BACKGROUND OF THE INVENTION

In the past, it has been common for wall hangings, such as pictures, mirrors, plate holders, etc., to be hung upon the wall by any one of several "center-balancing" techniques. These techniques differ only by the specific hardware employed and all depend upon the premise that the hanging can be leveled initially by balancing the hanging upon a centrally located nail or other wall-protruding element and resting the lower portion of the wall hanging itself against the wall to hold it in place. This technique has drawbacks or conditions attendant their use that make the "center-balancing" technique undesirable.

One problem is that, whether a nail and wire assembly or a nail and nail-bracket assembly are used, trial and error must be used to locate the wall hanging at the desired height, since the position of the nail on the wall bears no standard relation to final height of the wall hanging. This can result in several unsightly holes in the wall before the proper height is obtained. Another problem is that the conventional methods depend upon gravity to balance and level the wall hanging, so that the nail may also have to be moved to locate the proper horizontal position for the wall hanging. Furthermore, if the hanging is bumped or if the balancing relation is not perfectly centered, the hanging can shift out of position and become unlevel. Another problem is that a relatively large nail must be used for wall hangings of significant weight, since the conventional methods concentrate the full weight of the hanging on the support nail. Finally, the conventional methods result in a hanging which is not parallel to the wall surface, creating an unpleasant appearance.

BRIEF SUMMARY OF THE INVENTION

The present invention provides a method for securing wall hangings to a wall surface in a permanently leveled manner with the back of the wall hanging resting parallel to the wall surface. The invention also provides a hand tool for easily securing and leveling wall hangings to a wall surface which can be used with the method of the invention.

The method comprises the steps of attaching a plural number of double pointed pins to the rear of the wall hanging, preferably near the periphery, such as on the back of a frame, where one pin is centrally located near the bottom edge of the hanging and the others are symmetrically located near the upper edge of the hanging, preferably near opposite sides of the hanging. The pins are preferably attached to the hanging by use of the described tool of the invention. The hanging is then secured to the wall by pressing the bottom pin into the wall at the desired height and location on the wall. The hanging is then leveled, again preferably through use of the described tool, and the upper pins are pressed into the wall. In this manner, the hanging is permanently attached to the wall surface in a level and parallel fashion, without need for periodic adjustments and without damaging the wall.

In a slight variation of the method, wall hangings mounted in the conventional manner may be permanently secured in a level fashion by attaching a pin to the rear of the hanging near the center bottom, leveling the hanging and then pressing the pin into the wall.

The device of the invention, designed to be used with the above method of hanging a wall hanging, comprises a hand held tool having a body shaped to fit in the palm of one hand. The tool has a pin retaining face which temporarily holds a pin in position for insertion into the back of a wall hanging. The tool also contains a leveling means, such as a conventional bubble level, which is used to achieve the desired position of the wall hanging before the pins are inserted into the wall, the tool body being shaped such that the tool may be rested upon wall hangings of polygonal, circular or oval shape.

DETAILED DESCRIPTION OF THE INVENTION

The invention consists of both a method of securing wall hangings to a wall surface and a device capable of being used with the method. For purposes of this specification, a hanging or wall hanging shall mean any picture, mirror, or other object intended to be hung upon a wall, where the object is capable of retaining a metal pin inserted into its rear side, or the object has a frame or attached pieces which are so capable. A wall or wall surface shall mean any substantially vertical surface of a material capable of retaining a metal pin inserted into it, plus the weight of the wall hanging itself. When referring to the device of the invention, the term forward shall refer to the direction toward the hanging when the device is being used to insert a pin, i.e., the direction of insertion.

Figure 1:
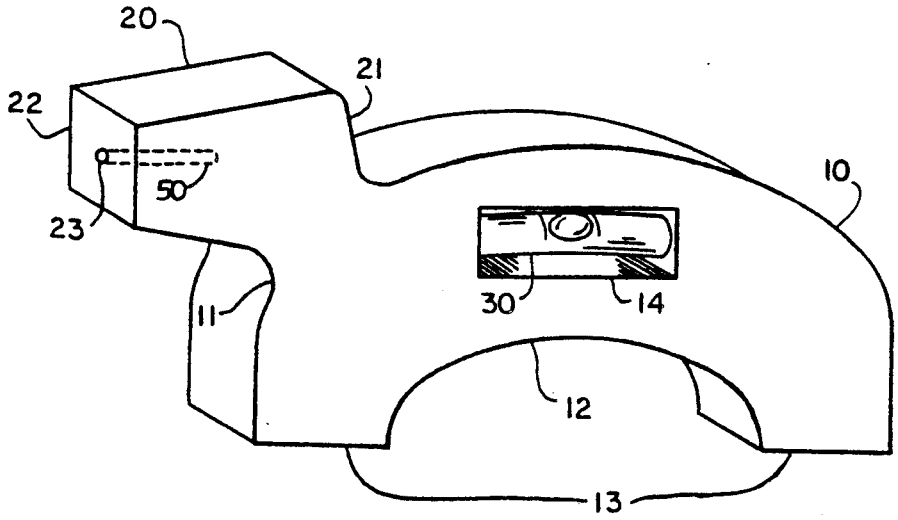
FIG. 1 is a perspective view of the device of the invention.
Figure 2:
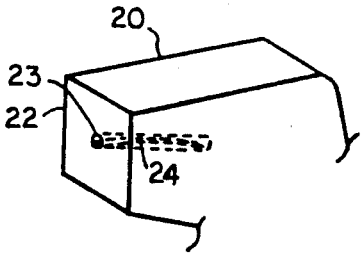
FIG. 2 is a perspective view of a portion of the device showing a leaf spring.
Figure 3:
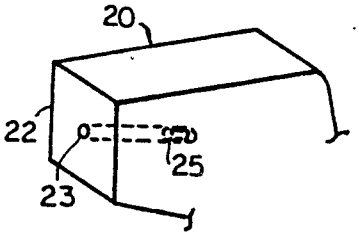
FIG. 3 is a perspective view of a portion of the device showing a metal plug.

With reference to FIG. 1, the device of the invention is illustrated. The device is a tool, shaped preferably as shown, which is capable of being held in the palm of one hand. The tool comprises a main body portion 10 and a head portion 20. The main body 10 is of a size such that the user can grip the tool with his thumb resting on the top of the main body 10, his index finger resting in the forward cut-out 11 and his remaining fingers resting in the bottom cut-out 12. As seen, forward cut-out 11 and bottom cut-out 12 are generally circular in shape. Head portion 20 comprises a thumb shoulder 21, an insertion face 22 and a pin holder 23. Thumb shoulder 21 extends from the main body 10 at a position forward of the user's thumb, providing a means for exerting pressure in the forward direction when inserting a pin into the hanging. Insertion face 22 is a . relatively planar face having an aperture 23 adapted to receive a pin for insertion into a hanging. This aperture, pin holder 23, can be of a size slightly larger than that of the pins being used or can be significantly larger if some retaining means 50, such as a leaf spring 24, is inserted to provide means to temporarily secure the pin in the device, as shown in FIG. 2. A metal plug 25 or similar means can also be inserted into the rear of pin holder 23 to prevent entry of the pin into the material of the device, where such material is not sufficiently hard enough to prevent this when the pin is being inserted into the wall hanging, as shown in FIG. 3. The lower side of main body 10 forms two leveling legs 13, which are relatively planar on their bottom surface and are suitable for resting the device on a planar upper surface of a wall hanging. Bottom cut-out 12 is used to rest the device on circular or oval upper surfaces of a wall hanging. A level aperture 14 is cut through the central portion of main body 10 and is adapted to receive a level indicating device, such as a bubble level 30, allowing the user to view the level 30 from either side. The level 30 is fixed relative to leveling legs 13 such that the bottom surfaces of leveling legs 13 are at true horizontal when the level 30 shows true horizontal.

Dimensions of the tool may vary within reasonable limits, but the tool is preferably about one half inch in thickness, about four to five inches in overall length and about three inches in overall height. It is preferable to use double pointed pins of small diameter, for instance 0.043 inches in diameter and seven-eighths inches in length, in which case the pin holder 23 should be 0.045 inches in diameter and one-half inch in depth. Of course, the pin size may vary, in which case the diameter and depth of pin holder 23 will be adjusted accordingly. Use of a larger aperture and a leaf spring 24 to retain the pin will allow for various size pins to be used with the same device. The device may be made of any suitable material such as hard plastic, metal or wood, as long as the material is of sufficient strength to withstand the pressures used to insert the pins and is of sufficient hardness such that the pin cannot penetrate the material.

The method of the invention will now be described in detail. The method is applicable for securing wall hangings to a wall surface where both the wall and the hanging are made of or have portions of material of a hardness which allow for the insertion of a metal pin and are of a strength sufficient to retain said pin in place. For example, wood and wall-board are suitable materials. Typically, the method is used to hang a picture having a wooden frame onto an interior house wall made of wall-board, and this situation will be used in the following description.

The method comprises the steps of inserting a double pointed metal pin into the pin holder 23 of the device previously described. The pin may be linear or can have two right angle bends to prevent over-insertion. The user then attaches the pin to the back of the picture frame by pressing the pin into the frame with the device held in the palm of his hand, using his thumb and hand to apply pressure in the forward direction. The pin is inserted up to the insertion face 22 of the device, at which time the device is removed, leaving the pin securely attached to the frame. Pins are placed near the center bottom portion of the frame and near each of the upper corners, although more pins in different locations may be added if needed or only one pin may be placed near the center top edge if the hanging is light in weight. Since the pins are double pointed, the hanging now has a number of pins protruding from the rear of the frame which can be pressed into the wall to retain the hanging in place. Should the hanging not have a frame or be of a material not suitable to receive the pins, small pieces of wood may be attached to the hanging and the pins inserted into these pieces.

The user now positions the hanging at the location on the wall where placement is desired and presses the bottom pin into the wall surface. This pin now acts as a pivot for adjusting the level of the hanging. The device is balanced on the top surface of the hanging, the device resting on its leveling legs 13 or its bottom cut-out 12, depending on the shape of the hanging. Sighting on the level 30, the user adjusts the hanging until it is level and then presses the remaining pins into the wall. The hanging is now permanently affixed to the wall in a level position with its back parallel to the wall surface.

A variation of this method can be used to permanently affix wall hangings in a level position which are currently secured by the conventional method. Only one pin is inserted into the rear of the bottom of the hanging. The hanging is rehung in the conventional manner, the tool is placed on top of the hanging and level 30 is used to properly align the hanging. The pin is then pressed into the wall and thus the hanging will no longer slip off level.

Through the use of the above described method and device, wall hangings may be secured in a permanently level fashion with backs parallel to the wall surface without creating significant damage to the wall surface. The above description has been by way of example only, and it will be obvious to those skilled in the art that obvious equivalents or substitutions may be made in the above disclosed steps and embodiments. The full scope of definition of the invention shall therefore be as set forth in the following claims.

I claim:

1. A device for securing and leveling wall hangings to a wall, comprising a main body portion to be held in the palm and fingers of a user, the main body portion having two legs separated by a central cut-out portion of sufficient size to allow the user's fingers to fit between said legs, said legs defining a planar bottom surface and said main body portion containing a level indicating means disposed parallel to said bottom surface, and further comprising a head portion integrally connected to said main body portion by an upper cut-out portion therebetween and upwardly and outwardly extended from said upper cut-out portion, an elongated pin holding aperture disposed parallel to said bottom surface and defined within said head portion, said aperture has an open end to temporarily recieve a pin, a closed end positioned within said head portion, and a retaining means located therein at said closed end to temporarily abut one end of said pin when said pin is hand pressed into the wall hanging by exerting pressure against the device, and further such that said pin will be left in the wall hanging upon removal of the device.

2. The device of claim 1, further comprising a leaf spring positioned within said pin holding aperture.

3. The device of claim 1, where the head portion further comprises a thumb shoulder such that pressure is applied against the device by pushing against said thumb shoulder.

4. The device of claim 1, where the level indicating means is a bubble level.

5. The device of claim 1, wherein said retaining means is a metal plug positioned within said pin holding aperture.

6. The device of claim 1, where the device is constructed of metal.

7. The device of claim 1, wherein the device is constructed of hard plastic.

* * * * *